US005580289A

United States Patent [19]

Åsberg

[11] Patent Number: 5,580,289

[45] Date of Patent: Dec. 3, 1996

[54] TRANSMISSION DEVICE IN AN OUTBOARD DRIVE UNIT FOR BOATS

[75] Inventor: Mikael Åsberg, Torslanda, Sweden

[73] Assignee: AB Volvo Penta, Gothenburg, Sweden

[21] Appl. No.: 272,385

[22] Filed: Jul. 6, 1994

[30] Foreign Application Priority Data

Jul. 16, 1993 [SE] Sweden ..... 9302438

[51] Int. Cl.[6] ..... B63H 21/26

[52] U.S. Cl. ..... 440/75

[58] Field of Search ..... 440/75, 76, 900; 74/369–372

[56] References Cited

U.S. PATENT DOCUMENTS 3,362,375 1/1968 Shimanckas ..... 440/75

4,747,795 5/1988 Kawamura et al. ..... 440/75

*Primary Examiner*—Jesus D. Sotelo

*Attorney, Agent, or Firm*—Young & Thompson

[57] ABSTRACT

Transmission device in an outboard drive unit for boats, comprising an input shaft (1) and an intermediate shaft (3) mounted perpendicular thereto, said intermediate shaft being driven by the input shaft via a pair of bevel gears (2, 6). The bevel gear on the intermediate shaft can be released and drives, via a counter gear, a gear (21) on a shaft (20) disposed parallel to the intermediate shaft and which has a releasable gear (23) in engagement with a gear (35) on the intermediate shaft.

8 Claims, 2 Drawing Sheets

TRANSMISSION DEVICE IN AN OUTBOARD DRIVE UNIT FOR BOATS

FIELD OF THE INVENTION

The present invention relates to a transmission device in an outboard drive unit for boats, comprising an input shaft connectable to a drive unit, an intermediate shaft disposed perpendicular to the input shaft, a pair of interengaging bevel gears disposed on respective shafts, of which at least the bevel gear on the intermediate shaft is rotatably mounted and lockable to the shaft by means of a clutch, and a reversing unit for changing the rotational direction of the intermediate shaft.

BACKGROUND OF THE INVENTION

A known transmission device of this type, included in a boat propeller drive unit of the Aquamatic®-type for example, has a commonly occurring figuration with an intermediate shaft with two rotatably mounted bevel gears engaging a bevel gear on an input shaft. The intermediate shaft bevel gears are alternately lockable to the intermediate shaft for driving the same in one or the other direction. They are also releasable at the same time in a neutral position. In such a configuration, the upper bevel gear on the intermediate shaft will necessarily be disposed at a level above the input shaft and will be the component which finally determines the height of the surrounding drive unit housing. The height of the drive unit housing is in turn the decisive factor in determining the maximum tipping angle within the so-called beaching range, i.e. the range to which the drive unit is tipped up when operating in very shallow water or when launching or hauling up the boat from or onto a boat trailer on a ramp. The higher the drive unit housing is above its tipping axis, the more the maximum tipping angle of the drive unit will be limited by adjacent components such as transom, the mounting shell, a swimming platform etc.

SUMMARY OF THE INVENTION

The purpose of the present invention is in general to provide a transmission device of the type described in the introduction, which, when used in an outboard drive unit of the Aquamatic-type for example, makes it possible to substantially reduce the height of the drive unit in comparison to known drive units of this type.

This is achieved according to the invention by virtue of the fact that the reversing unit comprises a second shaft disposed parallel to the intermediate shaft, transmission means driven by the bevel gear and mounted on the intermediate shaft, for driving the second shaft and a pair of cooperating gears arranged on the intermediate shaft and the second shaft, at least one of which is rotatably mounted and lockable to its shaft by means of a clutch.

The transmission device according to the invention eliminates the upper bevel gear on the intermediate shaft and uses the lower bevel gear for transmitting torque both in forward and reverse drive modes, the torque in the latter mode being transmitted via a freely rotating bevel gear to a reversing unit disposed to one side of the intermediate shaft, the configuration of which does not affect the height of the drive unit above the tipping axis.

The design according to the invention has a number of obvious advantages. The reduced height of the drive unit makes possible a greater maximum tipping angle, reduces the space requirements and permits the placement of the drive unit under a swimming platform for example, and reduces the dimensions of the drive housing and the mounting shell, thereby also reducing costs. Additional advantages, which will be evident in the following, include the possibility of different gear ratios for forward and reverse operation, access to a shaft which rotates both when propelling the boat and in the neutral position, for driving an oil pump for example, as well as the possibility of arranging an overdrive.

BRIEF DESCRIPTION OF THE DRAWINGS

The invention will be described in more detail below with reference to examples shown in the accompanying drawings, where.

DETAILED DESCRIPTION OF THE INVENTION

Figure 1:
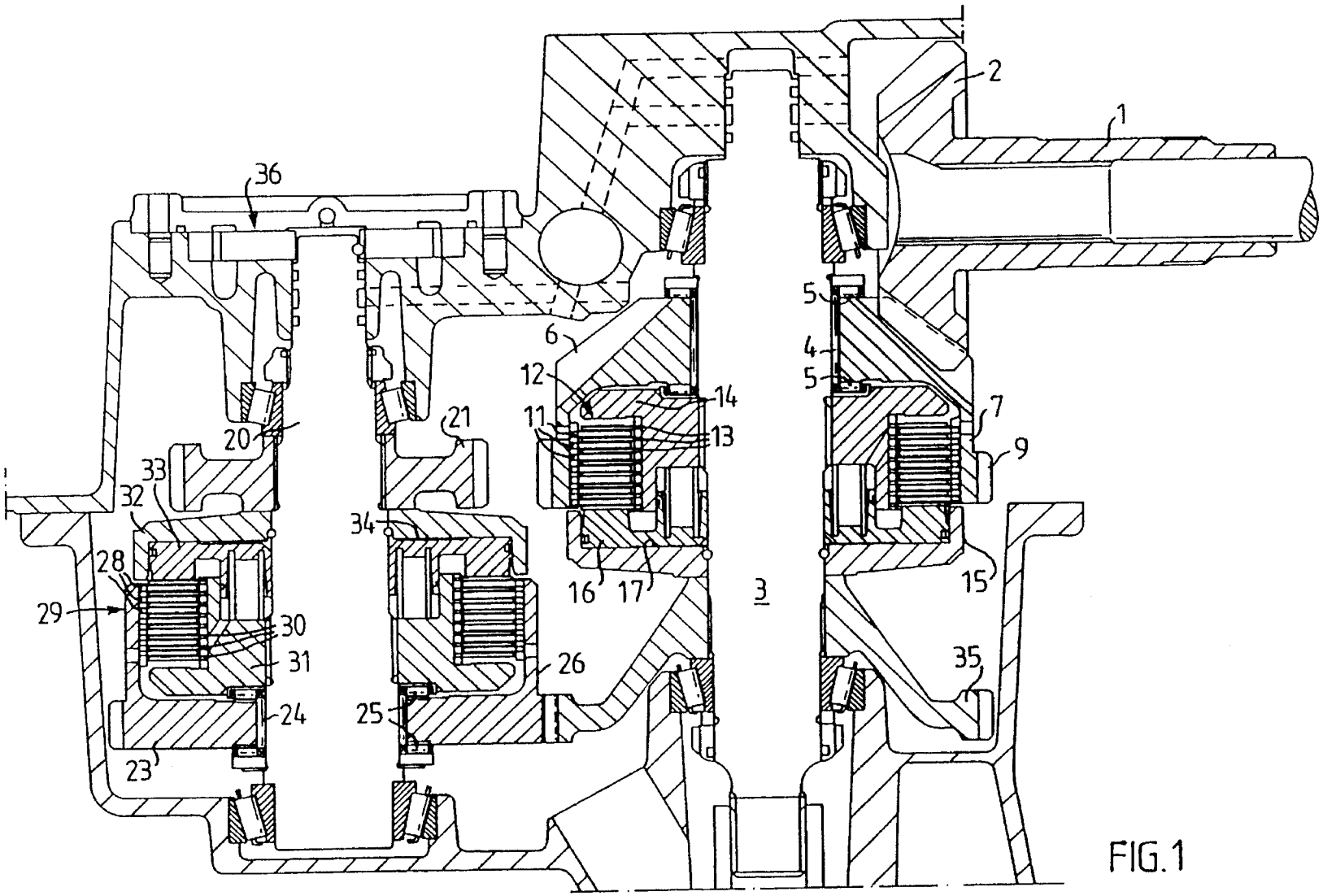
FIG. 1 shows a longitudinal section through a first embodiment of the transmission device according to the invention.

In the Figures, 1 designates an input shaft which is connected to an engine (not shown), to which input shaft a bevel gear 2 is non-rotatably joined. An intermediate shaft 3 is mounted perpendicular to the input shaft 1 and supports a bevel gear 6 mounted in a radial bearing 4 and two thrust bearings 5, said bevel gear 6 engaging the bevel gear 2. The gear 6 is made integral with a cylindrical flange portion 7, the outer lateral surface of which is provided with a toothed rim 9, and the interior lateral surface of which has non-rotatably fixed to it every other disc 11 in a disc package 12. The other discs 13 are non-rotatably fixed to a disc carrier 14 joined to the shaft 3. A hydraulic cylinder 15 fixed to the shaft 3 contains a hydraulic piston 16, by means of which the disc package 12 can be pressed together to lock the bevel gears 6 to the intermediate shaft 3 when hydraulic oil is supplied to the cylinder chamber 17 of the hydraulic cylinder 15.

Figure 2:
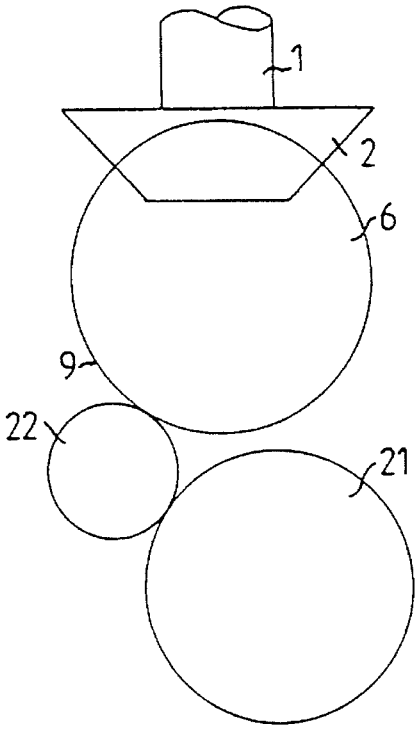
FIG. 2 is a schematic representation from above of the transmission device in FIG. 1.

To one side of the intermediate shaft 3 and parallel thereto a second shaft 20 is rotabably mounted. A gear 21 is non-rotatably fixed to the shaft 20 and engages, via a counter gear 22 (FIG. 2) the toothed rim, which means that the shaft 3 is driven constantly in the same direction as the toothed rim 9, when the input shaft 1 is driven. On the shaft 20 there is rotatably mounted a gear 23 in a radial bearing 24 and two thrust bearings 25. The gear 23 is made in one piece with a cylindrical flange portion 26, to the inner lateral surface of which there are fixed every other disc 28 is a disc package 29. The rest of the discs 30 are non-rotatably fixed to a disc carrier 31 joined to the shaft 20. A hydraulic cylinder 32 fixed to the shaft 20 contains a hydraulic piston 33, by means of which the disc package 29 can be pressed together to lock the gear 21 to the shaft 20 when hydraulic oil is supplied to the cylinder chamber 34 of the hydraulic cylinder 32. The gear 23 engages a gear 35 non-rotatably fixed to the intermediate shaft 6.

When operating the boat forward, the clutch 11–17 is engaged and the bevel gear 6 is locked to the intermediate shaft 3. The clutch 28–34 is disengaged. The torque is transmitted directly from the input shaft 1 to the intermediate shaft 3 and from there, via a lower bevel transmission to one or two propeller shafts (not shown). The shaft 20 is constantly driven via the toothed rim 9, the counter gear 22 and the gear 23. When shifting into reverse, the clutch 11–17 is disengaged and the clutch 28–34 is engaged. The torque is now transmitted via the gears 23 and 35 to the intermediate shaft 3, which is driven in the opposite direction. Hydraulic oil for controlling the clutches is supplied from an oil pump generally designated 36 which is driven by the shaft 20.

Figure 3:
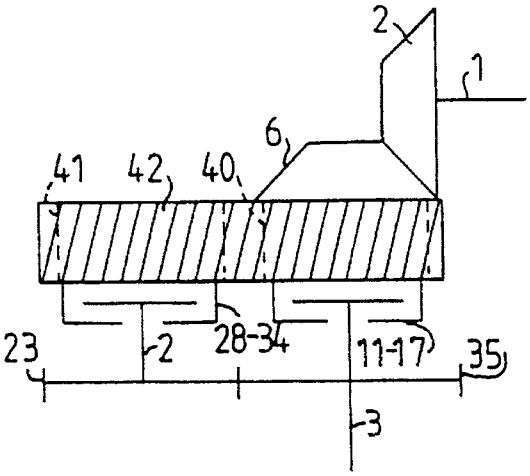
FIG. 3 is a schematic representation from the side of a second embodiment of a transmission device according to the invention.

FIG. 3 shows schematically an alternative embodiment for reversing the rotational direction of the intermediate shaft 3. The toothed rim 9, the counter gear 22 and the gear 23 have been replaced here with a pair of gears or sprocket wheels 40, 41 and a toothed belt or a chain 42.

Figure 4:
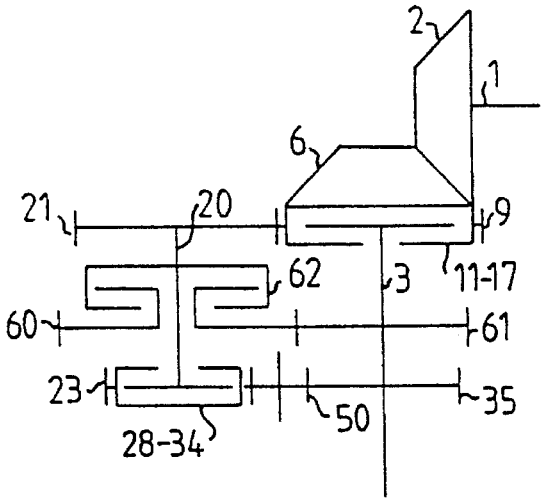
FIG. 4 is a third embodiment of a transmission device according to the invention.

FIG. 4 shows a third embodiment, in which the toothed rim 9 and the gear 21 are in direct engagement. A counter gear 40 for reversing the rotational direction of the intermediate shaft 3 is in this case arranged between the gears 23 and 25. This design permits additional gear speeds, for example an overdrive, effected by means of additional pair of gears 60, 61. The gear 60 on the shaft 20 is freely rotatably mounted and is lockable to the shaft by means of a clutch 62.

I claim:

1. Transmission device in an outboard drive unit for boats, comprising an input shaft connectable to a drive unit, an intermediate shaft disposed perpendicular to the input shaft, a pair of interengaging bevel gears disposed on respective shafts, of which at least the bevel gear on the intermediate shaft is rotatably mounted and lockable to the shaft by means of a clutch and a reversing unit for changing the rotational direction of the intermediate shaft, characterized in that the reversing unit comprises a second shaft (20) disposed parallel to the intermediate shaft (3), transmission means (9, 21, 22; 40, 41, 42) driven by the bevel gear (6) mounted on the intermediate shaft, for driving the second shaft and a pair of cooperating gears (23, 35) arranged on the intermediate shaft and the second shaft, at least one (23) of which is rotatably mounted and lockable to its shaft by means of a clutch (28–34).

2. Transmission device according to claim 1, characterized in that the clutches (11–17, 28–34) are hydraulically operated disc clutches.

3. Transmission device according to claim 1, characterized in that said transmission means (9, 21, 22) have a drive element (9; 40) solidly joined to the bevel gear (6) on the intermediate shaft.

4. Transmission device according to claim 3, characterized in that said drive element is a gear (9) which cooperates with a gear (21) on the second shaft via a counter gear (22) for driving the second shaft (20) in the same rotational direction as the first mentioned gear (9).

5. Transmission device according to claim 3, characterized in that said drive element is a sprocket wheel (40), which drives, via a toothed belt (42), a corresponding gear (41) on the second shaft (20) to drive the second shaft (20) in the same rotational direction as the sprocket wheel.

6. Transmission device according to claim 3, characterized in that said drive element is a gear (9), which engages a gear (21) on the second shaft, and that one of said cooperating gears (23, 35) drives the other via a counter gear (50).

7. Transmission device according to claim 6, characterized in that the intermediate shaft (3) and the second shaft (20) have an additional pair of gears (60, 61), which engage each other and one of which at least is freely rotatably mounted and lockable to its shaft by means of a clutch (62).

8. Transmission device according to claim 1, characterized in that the second shaft (20) is coupled for driving an oil pump (36).

* * * * *